US010095167B2

(12) United States Patent
Kibayashi

(10) Patent No.: US 10,095,167 B2
(45) Date of Patent: Oct. 9, 2018

(54) IMAGE FORMING APPARATUS FOR CONTROLLING A FIXING UNIT AND NON-TRANSITORY COMPUTER READABLE MEDIUM FOR THE SAME

(71) Applicant: FUJI XEROX CO., LTD., Tokyo (JP)

(72) Inventor: Susumu Kibayashi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 8 days.

(21) Appl. No.: 15/344,671

(22) Filed: Nov. 7, 2016

(65) Prior Publication Data

US 2017/0308012 A1 Oct. 26, 2017

(30) Foreign Application Priority Data

Apr. 26, 2016 (JP) ..... 2016-087808

(51) Int. Cl.
*G03G 15/20* (2006.01)
*G03G 15/00* (2006.01)

(52) U.S. Cl.
CPC ..... *G03G 15/2085* (2013.01); *G03G 15/2032* (2013.01); *G03G 15/2064* (2013.01); *G03G 15/652* (2013.01); *G03G 15/6564* (2013.01); *G03G 2215/00949* (2013.01); *G03G 2215/2045* (2013.01)

(58) Field of Classification Search
CPC ..... G03G 2215/00223; G03G 15/2032; G03G 15/2064; G03G 15/2085; G03G 15/652; G03G 15/6564; G03G 2215/00949; G03G 2215/2045
See application file for complete search history.

(56) References Cited

U.S. PATENT DOCUMENTS 4,377,333 A * 3/1983 Tsuji ..... G03G 15/6529 399/122
4,513,898 A * 4/1985 Spitsbergen ..... B65H 20/04 226/25
4,890,140 A * 12/1989 Negoro ..... B41J 11/30 219/216
5,023,667 A * 6/1991 Negoro ..... G03G 15/164 399/317

(Continued)

FOREIGN PATENT DOCUMENTS

JP 2003-63079 A 3/2003
JP 2005-262738 A 9/2005
JP 2016-7710 A 1/2016

*Primary Examiner* — David Bolduc
(74) *Attorney, Agent, or Firm* — Sughrue Mion, PLLC

(57) ABSTRACT

An image forming apparatus include a transport unit, a tension adjusting unit, a transfer unit, a fixing unit, and a controller. The transport unit transports continuous paper. The tension adjusting unit adjusts tension of the continuous paper being transported by the transport unit. The transfer unit transfers an image to the continuous paper transported by the transport unit. The fixing unit fixes the image transferred by the transfer unit onto the continuous paper. The controller controls, in a case where the fixing unit is driven in a state in which the fixing unit is separated from the continuous paper and a difference between a transport speed of the transport unit and a fixing speed of the fixing unit has reached a predetermined range, the fixing unit to be in press-contact with the continuous paper.

10 Claims, 9 Drawing Sheets

(56) References Cited

U.S. PATENT DOCUMENTS 5,063,416 A * 11/1991 Honda ..... B41J 15/06 226/24
5,087,947 A * 2/1992 Torino ..... G03G 15/2032 219/216
5,194,903 A * 3/1993 Negishi ..... G03G 15/6529 226/24
5,289,244 A * 2/1994 Takano ..... G03G 15/2028 219/216
5,305,068 A * 4/1994 Sato ..... B41J 11/30 226/59
5,325,164 A * 6/1994 Tai ..... G03G 15/2064 219/216
5,432,593 A * 7/1995 Nishikawa ..... G03G 15/2064 399/328
5,495,324 A * 2/1996 Kopp ..... G03G 15/2003 219/216
5,568,241 A * 10/1996 Creutzmann ..... G03G 15/2003 219/216
5,758,227 A * 5/1998 Kopp ..... G03G 15/2003 399/384
5,839,046 A * 11/1998 Takano ..... B41J 11/002 399/118
5,842,098 A * 11/1998 Ueno ..... G03G 15/2003 399/322
5,940,669 A * 8/1999 Bacus ..... G03G 15/0812 399/302
5,956,554 A * 9/1999 Yanashima ..... G03G 15/2064 399/328
6,047,156 A * 4/2000 De Bock ..... G03G 15/0131 399/298
7,454,162 B2 * 11/2008 Segerer ..... G03G 15/6538 399/341
7,890,038 B2 * 2/2011 Chikugo ..... G03G 15/2032 399/122
8,478,177 B2 * 7/2013 Kurita ..... G03G 15/2028 219/216
2002/0031361 A1 * 3/2002 Shiiya ..... G03G 15/2032 399/68
2003/0039497 A1 2/2003 Shimoyama
2004/0190952 A1 * 9/2004 Tanimoto ..... G03G 15/167 399/313
2006/0056861 A1 * 3/2006 Nojima ..... G03G 15/6564 399/16
2006/0285866 A1 * 12/2006 Kim ..... G03G 15/2046 399/68
2007/0140750 A1 * 6/2007 Hamano ..... G03G 15/0131 399/301
2007/0196119 A1 * 8/2007 Fujita ..... G03G 15/2039 399/68
2007/0292154 A1 * 12/2007 Ishikuro ..... G03G 15/2064 399/67
2008/0240750 A1 * 10/2008 Hanamoto ..... G03G 21/1623 399/45
2009/0263151 A1 * 10/2009 Deguchi ..... G03G 15/2039 399/70
2010/0309488 A1 * 12/2010 Koyama ..... G03G 15/5029 369/103
2010/0310264 A1 * 12/2010 Ishida ..... G03G 15/5029 399/45
2011/0026991 A1 * 2/2011 Izawa ..... G03G 15/2007 399/336
2011/0064468 A1 * 3/2011 Kawahata ..... G03G 15/2053 399/122
2013/0045019 A1 * 2/2013 Matsuzuki ..... G03G 15/201 399/67
2013/0148987 A1 * 6/2013 Arakawa ..... G03G 15/5062 399/15
2013/0279922 A1 * 10/2013 Ruiz ..... G03G 15/2035 399/21
2015/0030343 A1 * 1/2015 Kurita ..... G03G 15/2017 399/67
2015/0063846 A1 * 3/2015 Fukai ..... G03G 15/2067 399/45
2015/0355584 A1 * 12/2015 Ishikawa ..... G03G 15/6517 399/69
2016/0161895 A1 6/2016 Sasaki et al.

* cited by examiner

IMAGE FORMING APPARATUS FOR CONTROLLING A FIXING UNIT AND NON-TRANSITORY COMPUTER READABLE MEDIUM FOR THE SAME

CROSS-REFERENCE TO RELATED APPLICATIONS

This application is based on and claims priority under 35 USC 119 from Japanese Patent Application No. 2016-087808 filed Apr. 26, 2016.

BACKGROUND

Technical Field

The present invention relates to an image forming apparatus and a non-transitory computer readable medium.

SUMMARY

According to an aspect of the invention, there is provided an image forming apparatus including a transport unit, a tension adjusting unit, a transfer unit, a fixing unit, and a controller. The transport unit transports continuous paper. The tension adjusting unit adjusts tension of the continuous paper being transported by the transport unit. The transfer unit transfers an image to the continuous paper transported by the transport unit. The fixing unit fixes the image transferred by the transfer unit onto the continuous paper. The controller controls, in a case where the fixing unit is driven in a state in which the fixing unit is separated from the continuous paper and a difference between a transport speed of the transport unit and a fixing speed of the fixing unit has reached a predetermined range, the fixing unit to be in press-contact with the continuous paper.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described in detail with reference to drawings.

Figure 1:
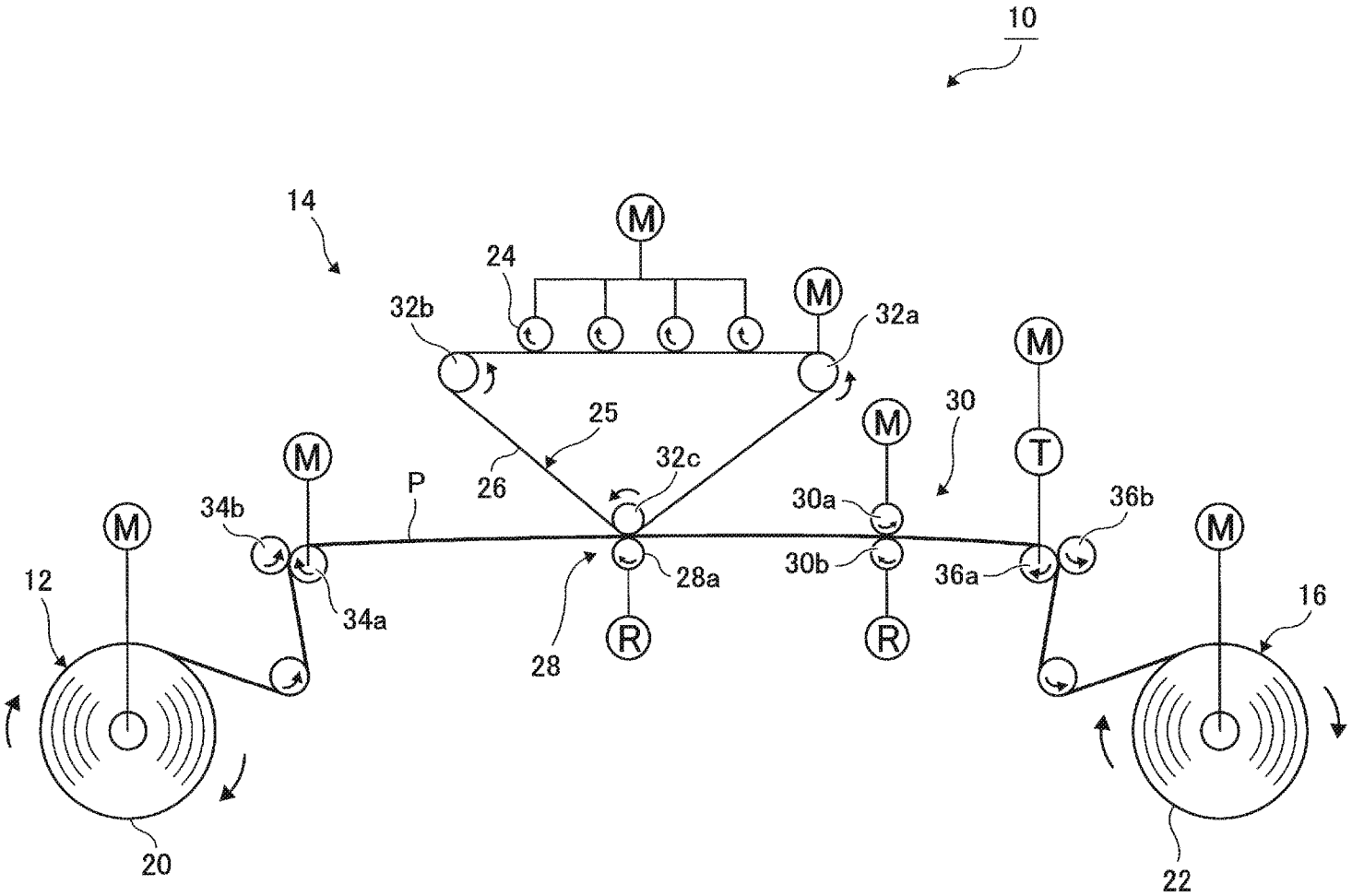
FIG. 1 is a diagram illustrating a schematic configuration of an image forming apparatus in a contact (press-contact) state according to an exemplary embodiment of the present invention.
Figure 2:
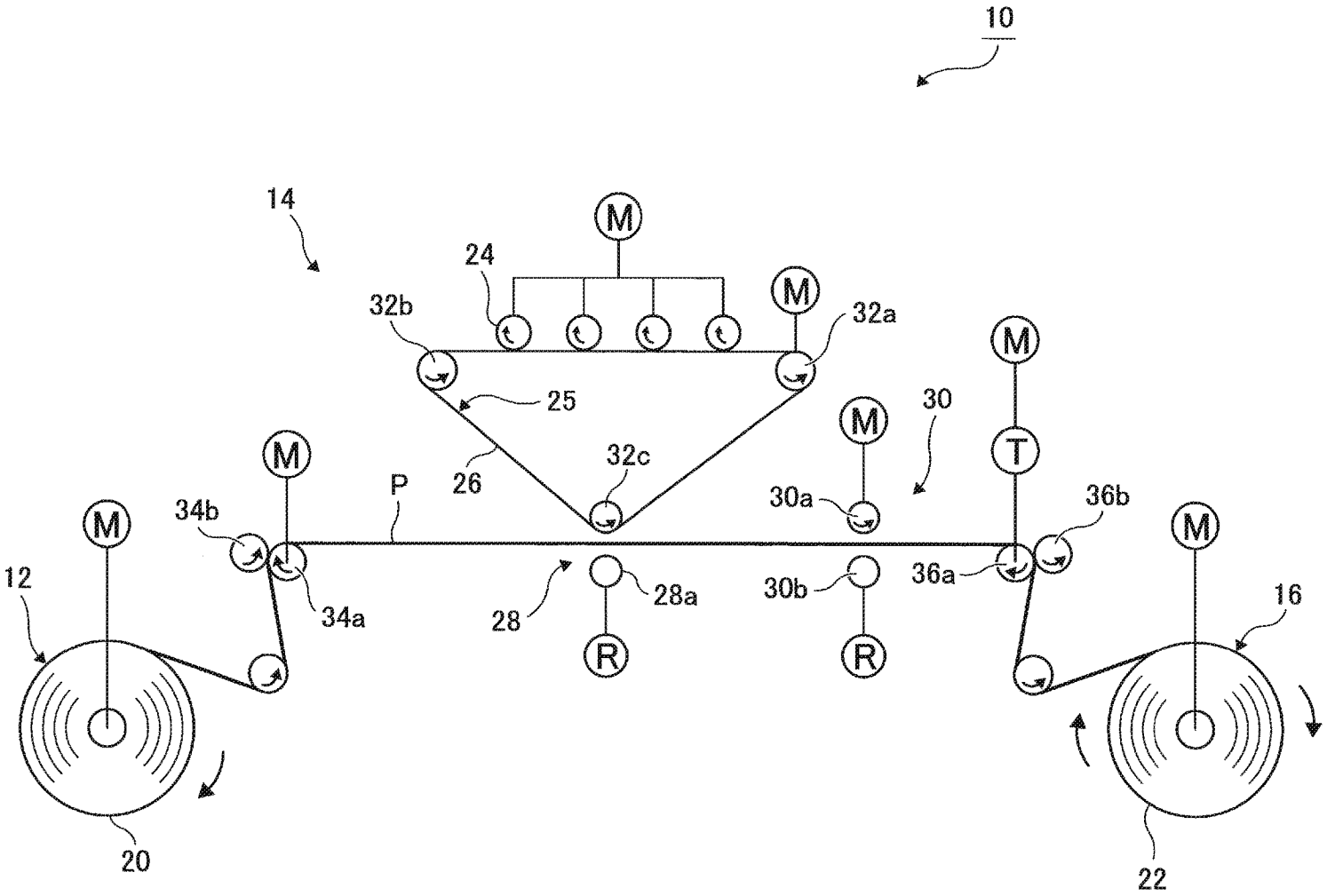
FIG. 2 is a diagram illustrating a schematic configuration of an image forming apparatus in a separation state according to an exemplary embodiment of the present invention.

FIGS. 1 and 2 are diagrams each illustrating a schematic configuration of an image forming apparatus 10 according to an exemplary embodiment of the present invention. As illustrated in FIGS. 1 and 2, the image forming apparatus 10 includes an unwinding device 12 which unwinds continuous paper P as a recording medium, an image forming unit 14 which forms an image on the continuous paper P which is unwound from the unwinding unit 12, a winding device 16 which winds the continuous paper P on which an image has been formed by the image forming unit 14, and a controller 18 which controls each of the unwinding device 12, the image forming unit 14, and the winding device 16.

The unwinding device 12 includes an unwinding roll 20 which is formed of the continuous paper P which has been wound in a roll form. To the unwinding roll 20, a motor M as a driving unit is connected. The unwinding roll 20 is driven to rotate by driving of the motor M, and the continuous paper P is thus supplied to the image forming unit 14.

The winding device 16 includes a winding roll 22 around which the continuous paper P on which an image has been formed by the image forming unit 14 is wound in a roll form. To the winding roll 22, a motor M is connected. The winding roll 22 is driven to rotate by driving of the motor M, and the continuous paper P on which an image has been formed is thus wound.

The image forming unit 14 forms, based on image information, an image using toner of four colors: yellow (Y), magenta (M), cyan (C), and black (K), on the continuous paper P. The image forming unit 14 includes four photoreceptors 24 which form toner images of corresponding Y, M, C, and K colors, an intermediate transfer device 25 which holds the toner images formed at the photoreceptors 24 and transports the toner images to a second transfer position at which second transfer of the toner images is performed onto the continuous paper P, a second transfer device 28 which performs second transfer of the toner images onto the continuous paper P at the second transfer position, a fixing device 30 which fixes the toner images on the continuous paper P which have been subjected to second transfer by the second transfer device 28, and the like.

A charging device, an exposing device, a developing device, a first transfer device, a cleaning device, and the like (not illustrated in FIG. 1) are arranged around each of the photoreceptors 24, and toner images formed on the photoreceptors 24 are transferred to the intermediate transfer device 25. In the case where monochrome setting is performed, only elements for black are operable. A motor M is connected to the photoreceptors 24, and the photoreceptors 24 are thus controlled by the controller 18.

The intermediate transfer device 25 includes an intermediate transfer belt 26 which rotates while passing through a first transfer position located between the photoreceptors 24 and the first transfer device, which is not illustrated in FIG. 1, multiple support rolls 32*a*, 32*b*, and 32*c* which support the intermediate transfer belt 26 in a rotatable manner, and the second transfer device 28 which performs second transfer of a toner image on the intermediate transfer belt 26 onto the continuous paper P. A motor M is connected to the support roll 32*a*, and the support roll 32*a* is thus controlled by the controller 18.

The second transfer device 28 includes a second transfer roll 28*a* which is in contact with a peripheral surface of the intermediate transfer belt 26 and rotates at the second transfer position, which is an outer peripheral surface part of the intermediate transfer belt 26 supported by the support roll 32*c*. The second transfer device 28 includes, as illustrated in FIG. 2, a moving mechanism R which moves the second transfer roll 28*a* so as to be separated from the continuous paper P.

In the fixing device 30, a heating roll 30*a* which is heated by a heating unit so that the surface temperature is maintained at a predetermined temperature and a pressurizing roll 30*b* which is in contact with the heating roll 30*a* with a predetermined pressure and rotates are arranged facing each other with a transport path of the continuous paper P therebetween. At the fixing device 30, fixing processing is performed by heating and pressurizing a toner image which has been transferred onto the continuous paper P by the second transfer device 28. The fixing device 30 includes, as illustrated in FIG. 2, a moving mechanism R which moves the pressurizing roll 30*b* so as to be separated from the continuous paper P. A motor M is connected to the heating roll 30*a*, and the heating roll 30*a* is thus controlled by the controller 18.

On the upstream side of the second transfer device 28 in the direction in which the continuous paper P is transported, a first driving roll 34*a* as a first transport part and a pinch roll 34*b* which is in press-contact with the first driving roll 34*a* to provide pinch pressure and is driven to rotate are provided. Due to an increase of friction between the continuous paper P and the first driving roll 34*a* caused by the pinch pressure, driving transport force increases, and the continuous paper P may be transported reliably. A motor M is connected to the first driving roll 34*a*, and the first driving roll 34*a* is thus driven at a constant speed (rotation speed) under the control of the controller 18.

On the downstream side of the fixing device 30 in the direction in which the continuous paper P is transported, a second driving roll 36*a* as a second transport part and a pinch roll 36*b* which is in press-contact with the second driving roll 36*a* to provide pinch pressure and is driven to rotate, in a manner similar to the pinch roll 34*b*, are provided. A motor M is connected to the second driving roll 36*a* via a torque limiter T, and the second driving roll 36*a* is thus driven at a constant transport force under the control of the controller 18. This configuration is used as a tension adjusting unit.

Figure 3:
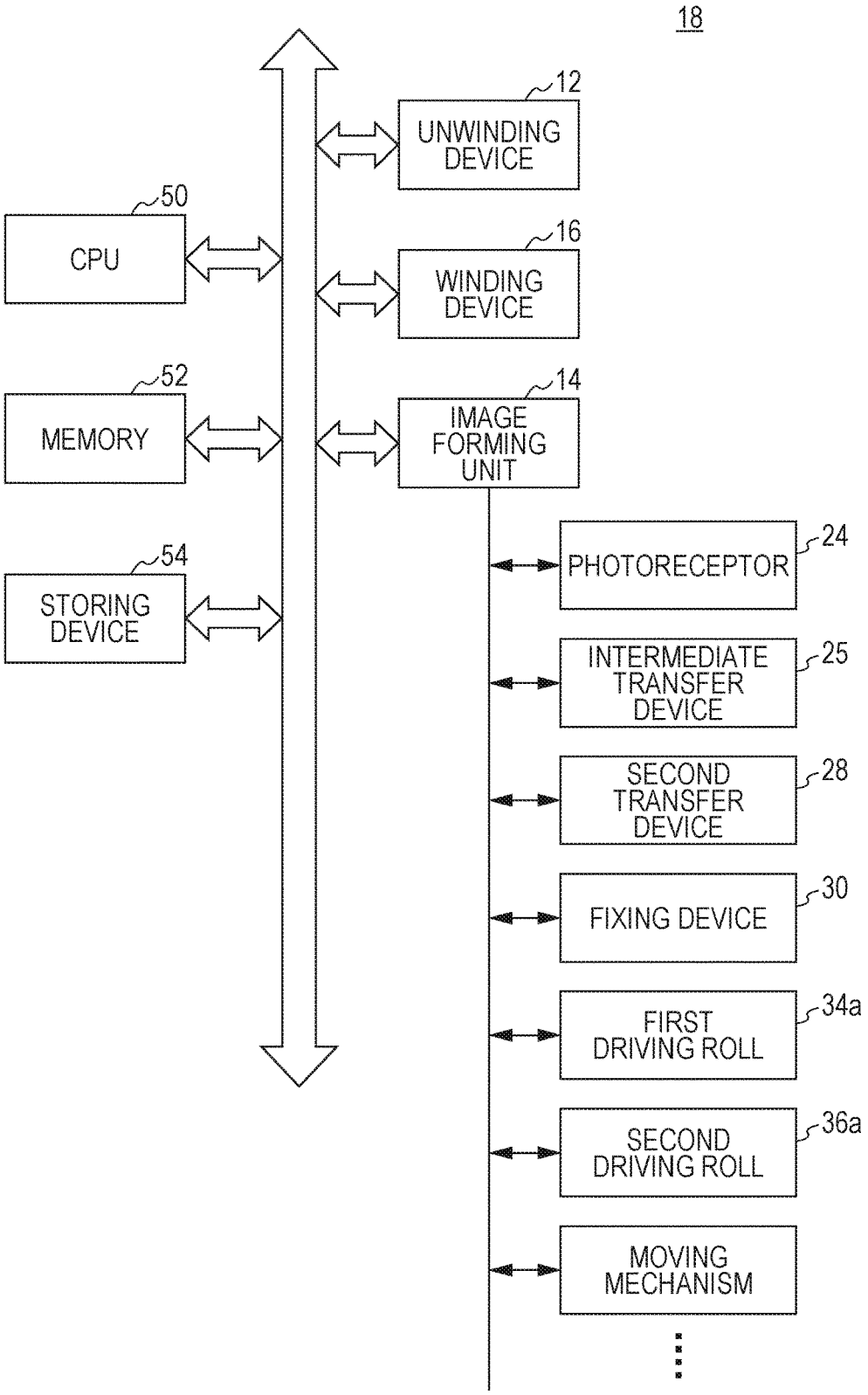
FIG. 3 is a block diagram illustrating a control configuration of an image forming apparatus according to an exemplary embodiment of the present invention.

FIG. 3 is a block diagram illustrating a control configuration of the controller 18 of the image forming apparatus 10.

As illustrated in FIG. 3, the image forming apparatus 10 is configured such that a central processing unit (CPU) 50, a memory 52, and a storing device 54 are connected by a bus.

The CPU 50 controls operation of the image forming apparatus 10 by executing a program written in the memory 52 or the storing device 54.

The CPU 50 may execute a program stored in a portable storing medium such as a compact disc-read only memory (CD-ROM), which is not illustrated in FIG. 3, or may execute a program supplied via a communication apparatus, which is not illustrated in FIG. 3.

For example, a hard disk or the like is used as the storing device 54. The storing device 54 stores data in a manner such that the data may be written and read.

Next, operation of the image forming apparatus 10 according to an exemplary embodiment of the present invention will be described.

Figure 4:
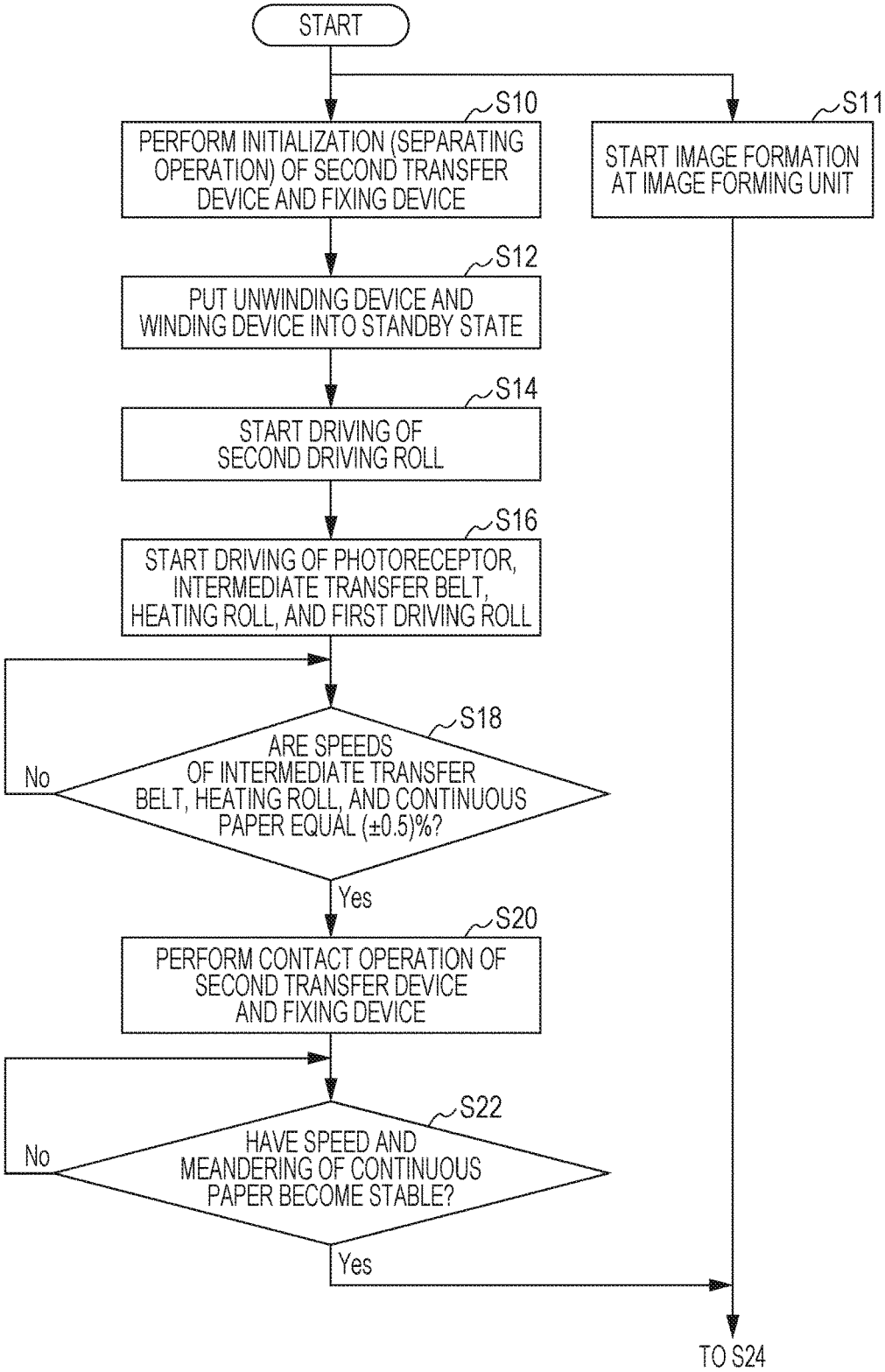
FIG. 4 is a flowchart for explaining an operation of an image forming apparatus according to an exemplary embodiment of the present invention.
Figure 5:
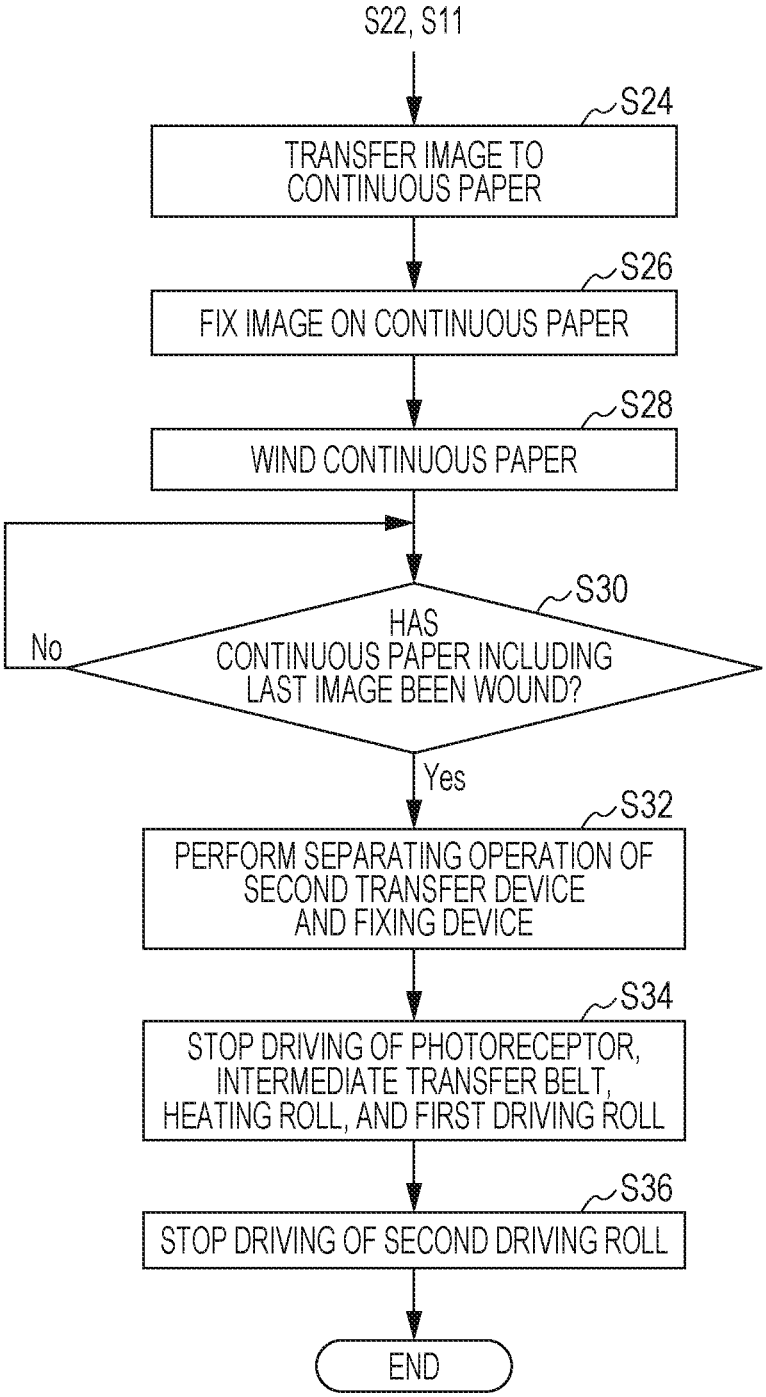
FIG. 5 is a flowchart for explaining an operation of an image forming apparatus according to an exemplary embodiment of the present invention.

FIGS. 4 and 5 are flowcharts illustrating operation of the image forming apparatus 10 according to an exemplary embodiment of the present invention. A program for execution of the operation is executed by the CPU 50 of the controller 18.

In step S10, the second transfer device 28 and the fixing device 30 are initialized, the second transfer roll 28*a* and the pressurizing roll 30*b* are moved to positions away from the continuous paper P by operation of the moving mechanism R, as illustrated in FIG. 2, and the second transfer device 28 and the fixing device 30 are thus separated from the continuous paper P (separating operation).

In step S11, concurrently with step S10, the image forming unit 14 starts image formation.

In step S12, the unwinding device 12 and the winding device 16 are put into a standby state. In the case where the unwinding device 12 and the winding device 16 are in the standby state, when driving of the first driving roll 34*a* is started, the unwinding device 12 and the winding device 16 automatically start unwinding and winding of the continuous paper P.

In step S14, driving of the second driving roll 36*a* is started. In the case where the torque limiter T is connected to the second driving roll 36*a*, the second driving roll 36*a* is driven first. The torque limiter T slips. Therefore, at this point in time, the continuous paper P is not transported.

In step S16, about 0.1 seconds after driving of the second driving roll 36*a*, driving of the first driving roll 34*a*, the photoreceptors 24, the intermediate transfer belt 26, the heating roll 30*a*, and the like are started.

In step S18, it is determined whether or not the speed of the intermediate transfer belt 26, the speed of the heating roll 30*a*, and the transport speed of the continuous paper P are equal. As described later, the state in which the speed of the intermediate transfer belt 26, the speed of the heating roll 30*a*, and the transport speed of the continuous paper P are equal includes a case where the difference between the transport speed of the continuous paper P and each of the speed of the intermediate transfer belt 26 and the speed of the heating roll 30*a* is within a range from approximately −0.5% to approximately 0.5%. In the case where the speed of the intermediate transfer belt 26, the speed of the heating roll 30*a*, and the transport speed of the continuous paper P are equal, the process proceeds to step S20. In the case where the speed of the intermediate transfer belt 26, the speed of the heating roll 30*a*, and the transport speed of the continuous paper P are not equal, the determination is performed repeatedly. The determination as to whether or not the speed of the intermediate transfer belt 26, the speed of the heating roll 30*a*, and the transport speed of the continuous paper P are equal may be made by determining, using a timer or the like based on a design value, that the speed of the intermediate transfer belt 26, the speed of the heating roll 30*a*, and the transport speed of the continuous paper P are equal after a certain period of time has passed, detecting the speed of the intermediate transfer belt 26, the speed of the heating roll 30*a*, and the transport speed of the continuous paper P, or the like.

In step S20, as illustrated in FIG. 1, a contact (press-contact) operation of the second transfer device 28 and the fixing device 30 is performed. Specifically, operation of the moving mechanism R causes the second transfer roll 28*a* to move in the direction in which the continuous paper P is made in contact with the intermediate transfer belt 26. Furthermore, operation of the moving mechanism R causes the pressurizing roll 30*b* to move in the direction in which the continuous paper P is made in contact with the heating roll 30*a*.

In step S22, it is determined whether or not the speed and meandering of the continuous paper P have become stable. In the case where the speed and meandering of the continuous paper P have become stable, the process proceeds to step S24. In the case where the speed and meandering of the continuous paper P have not become stable, the determination is performed repeatedly. If the fixing device 30 or the like is in contact with the continuous paper P, the speed and meandering of the continuous paper P may be unstable. Therefore, after the speed and meandering of the continuous paper P become stable, transfer of an image is started. In the case where a detector for detecting speed and meandering is not provided, when a certain period of time has passed, speed and meandering may be considered as having become stable.

In step S24, the second transfer device 28 transfers the image onto the continuous paper P.

In step S26, the fixing device 30 fixes the image which has been transferred onto the continuous paper P.

In step S28, the winding device 16 winds the continuous paper P including an image part.

In step S30, it is determined whether or not the continuous paper including the last image has been wound by the winding device 16. In the case where the continuous paper including the last image has been wound by the winding device 16, the process proceeds to step S32. In the case where the continuous paper including the last image has not been wound by the winding device 16, the determination is performed repeatedly.

In step S32, a separating operation of the second transfer device 28 and the fixing device 30 is performed. Specifically, as illustrated in FIG. 2, operation of the moving mechanism R causes the second transfer roll 28*a* to move in the direction in which the continuous paper P is separated from the intermediate transfer belt 26.

Furthermore, operation of the moving mechanism R causes the pressurizing roll 30*b* to move in the direction in which the continuous paper P is separated from the heating roll 30*a*.

In step S34, driving of the processing unit 24, the intermediate transfer belt 26, the heating roll 30*a*, and the first driving roll 34*a* is stopped.

In step S36, driving of the second driving roll 36*a* is stopped. The second driving roll 36*a* is stopped after driving of the first driving roll 34*a* is stopped. Therefore, the apparatus may be stopped with the tension of the continuous paper P within the apparatus maintained.

Figure 6:
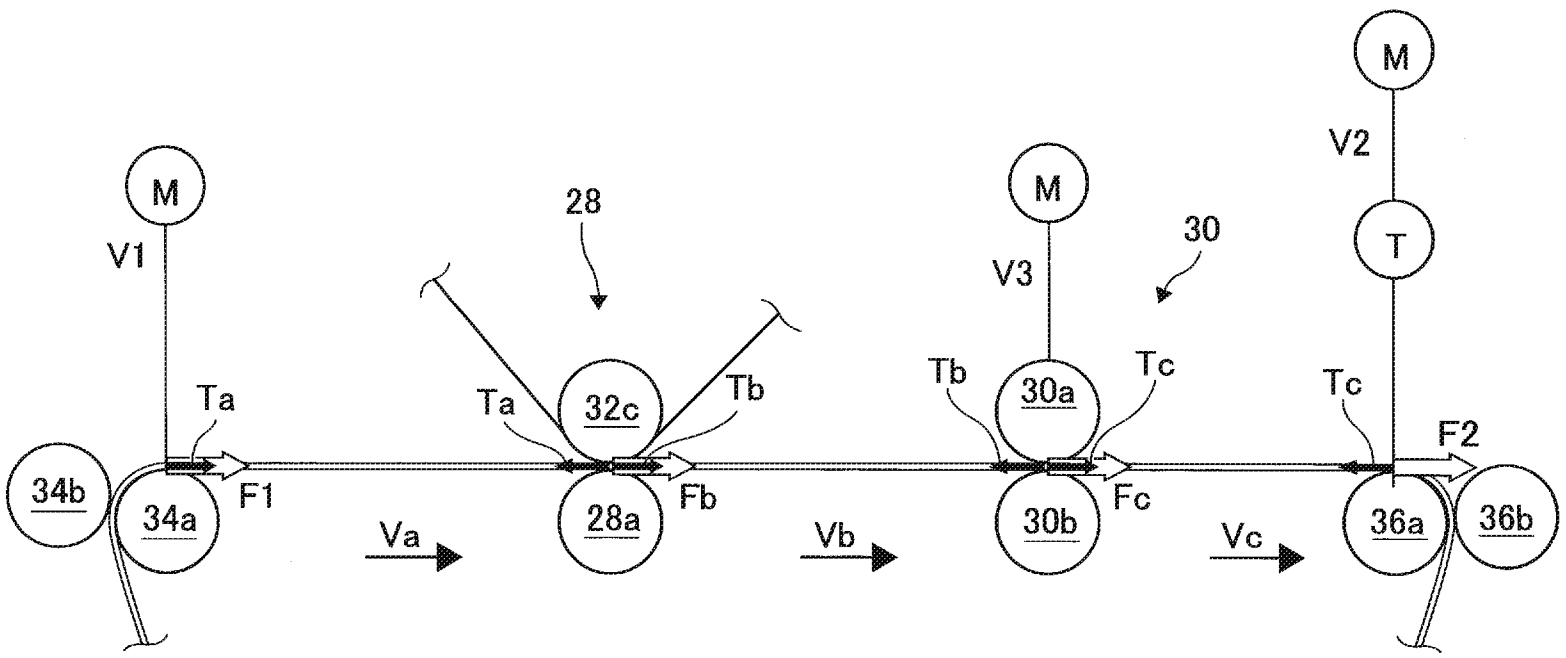
FIG. 6 is a diagram illustrating the relationship of transport speed V, tension T, and transport force F of continuous paper in each section in the case where a second transfer device and a fixing device are in a contact (press-contact) state.

FIG. 6 is a diagram schematically illustrating the relationship of transport speed V, tension T, and transport force F of the continuous paper P in each section in a state (contact state) in which the second transfer device 28 and the fixing device 30 are in press-contact with the continuous paper P.

The first driving roll 34*a* is connected to the motor M, and the driving speed of the first driving roll 34*a* is constant (V1). The second driving roll 36*a* is connected to the motor M via the torque limiter T, as described above, and the transport force of the second driving roll 36*a* is constant (F2). With this configuration, the transport speed V of the continuous paper P is determined based on the speed V1 of the first driving roll 34*a*, and the tension T provided to the continuous paper P is determined based on the transport force F2 of the second driving roll 36*a*.

A transport force F1 of the first driving roll 34*a* is determined based on the surface friction force, tension, and pinch pressure of the roll. The transport force F1 of the first driving roll 34*a* is set to be greater than the transport force F2 of the second driving roll 36*a* described above (F1>F2).

Furthermore, in the case where the transport speed after second transfer and before fixation in the state in which the second transfer device 28 and the fixing device 30 are in press-contact with the continuous paper P is represented by Vb, the transport force of the second transfer device 28 is represented by Fb, the transport speed after fixation is represented by Vc, and the transport force of the fixing device 30 is represented by Fc, the transport force Fb of the second transfer device 28 and the transport force Fc of the fixing device 30 are set to be smaller than the transport force F2 of the second driving roll 36*a* (F2>Fb, Fc).

In the case where tension of the continuous paper P located between the first driving roll 34*a* and the second transfer device 28 is represented by tension Ta, tension of the continuous paper P located between the second transfer device 28 and the fixing device 30 is represented by tension Tb, and tension of the continuous paper P located between the fixing device 30 and the second driving roll 36*a* is represented by tension Tc, the tension Tc may be set to be equal to the transport force F2 of the second driving roll 36*a*. Consequently, the tension Tb is set to be equal to the sum of the tension Tc and the transport force Fc of the fixing device 30, and the tension Ta is set to be equal to the sum of the tension Tb and the transport force Fb of the second transfer device 28. Accordingly, the tensions T at locations within a range from the first driving roll 34*a* to the second driving roll 36*a* may be set.

That is, by changing the setting value (transport force F2) of the torque limiter T, the tensions Ta, Tb, and Tc in individual sections may be changed.

Furthermore, the speed V1 of the first driving roll 34*a* is expressed by an equation: $V1=(r1+t/2)\cdot\omega 1$, where the driving roll rotation speed is represented by $\omega 1$, the driving roll radius is represented by r1, and the thickness of continuous paper is represented by t.

The transported continuous paper P expands or contracts by the tension Ta. Therefore, the transport speed Va of the continuous paper P located between the first driving roll 34*a* and the second transfer device 28 is expressed by an equation: $Va=V1\cdot(1+Ta/WtE)$, where the width of the continuous paper P is represented by W, the thickness of the continuous paper P is represented by t, and the Young's modulus of the continuous paper P is represented by E.

Similarly, the transport speed Vb after second transfer is expressed by an equation: $Vb=V1\cdot(1+Tb/WtE)$.

Similarly, the transport speed Vc after fixation is expressed by an equation: $Vc=V1\cdot(1+Tc/WtE)$.

In the case where driving is started in the state in which the second transfer device 28 and the fixing device 30 are in press-contact with the continuous paper P as illustrated in FIG. 6, the transport force F may be measured based on the force of pulling out the continuous paper P in the state in which each device is in press-contact with the continuous paper P.

In general electrophotographic systems (about 300 mm width), the transport force Fb of the second transfer device 28 is about 10 N to 30 N, and the transport force Fc of the fixing device 30 is about 50 N to 200 N. As described above, the transport force Fc of the fixing device 30 is large. Therefore, in order to start the apparatus in this state, the transport force F2 of the second driving roll 36*a* and the transport force F1 of the first driving roll 34*a* need to be greater than the transport force Fc of the fixing device 30. In particular, in order support high speed and high image quality, the fixing device 30 needs to have a high pressure. Therefore, the transport force Fc increases, and a large transport force F2 is required.

Accordingly, a large tension T is to be set. In order to have a configuration to tolerate a large tension T, the size of the apparatus may increase, a high cost may be required, and the continuous paper P may be broken.

Figure 7:
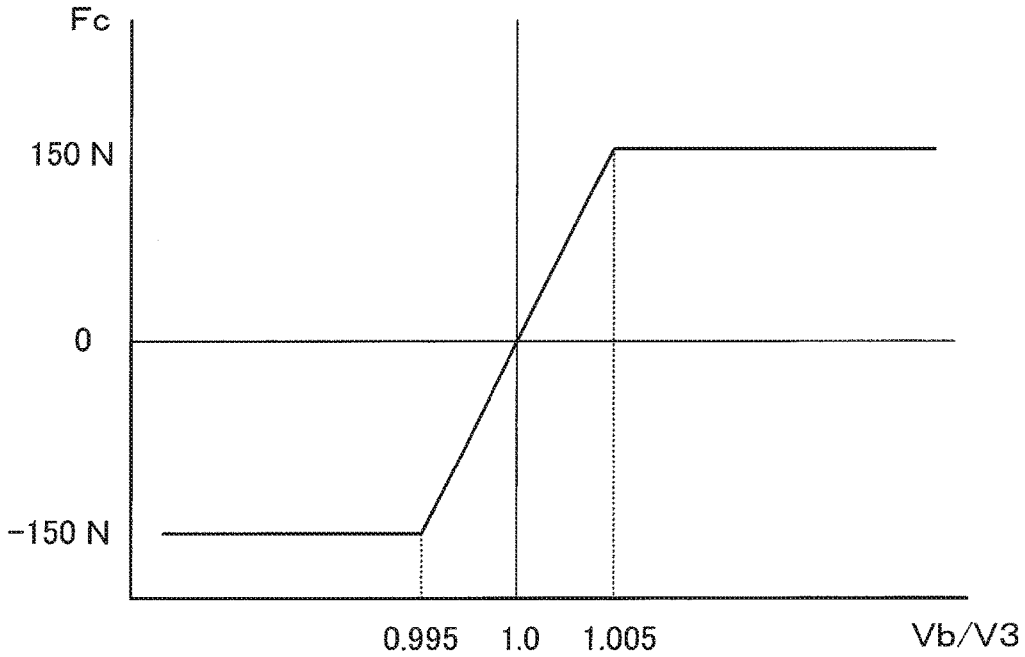
FIG. 7 is a diagram illustrating the relationship of transport speed Vb and fixing speed V3 before continuous paper is fixed and transport force Fc of the fixing device.

FIG. 7 illustrates the relationship of the transport speed Vb of the continuous paper P after second transfer and before fixation, the fixing speed V3 set for the fixing device 30, and the transport force Fc of the fixing device 30.

As is clear from FIG. 7, by setting the fixing speed V3 and the transport speed Vb before fixation to be substantially equal within a range satisfying an expression: $0.995<Vb/V3<1.005$, that is, within a range from approximately −0.5% to approximately 0.5%, the transport force Fc of the fixing device 30 decreases.

That is, by making the fixing device 30 in contact with the continuous paper P in the state in which the fixing speed V3 and the transport speed Vb before fixation are substantially equal, the transport force Fc of the fixing device 30 may be decreased. In addition, by changing the speed difference Vb/V3, the transport force Fc may be changed. By decreasing the transport force Fc of the fixing device 30, the transport force F2 of the second driving roll 36*a* and the transport force F1 of the first driving roll 34*a* do not need to be large. Therefore, the size of the apparatus may be reduced, and various types of continuous paper P may be used. Furthermore, the tension T may be maintained constant, and stable transport of continuous paper without meandering, image deviation, or density unevenness may be achieved. Moreover, by setting the relationship of the fixing speed V3 and the transport speed Vb before fixation, tension may be controlled. Accordingly, an optimal tension corresponding to the type and size of continuous paper may be set, and setting of an image magnification may also be performed.

The second transfer device 28 has properties similar to the fixing device 30. However, contact pressure of the second transfer device 28 is not as high as the fixing device 30, and the transport force Fb of the second transfer device 28 is small. That is, the transport force Fb may be set to be smaller than the transport force F1 of the first driving roll 34*a*, and therefore, the tension T is less affected by the transport force Fb.

As described above, the second transfer device 28 and the fixing device 30 of the image forming apparatus 10 according to an exemplary embodiment are configured to be separable from the continuous paper P. Driving of the second transfer device 28 and the fixing device 30 is started in the state in which the second transfer roll 28*a* and the pressurizing roll 30*b* are separated from the continuous paper P. Then, when the transport speed and fixing speed of the continuous paper P have become substantially equal with the difference between the transport speed and the fixing speed being within a range from approximately −0.5% to approximately 0.5%, the second transfer device 28 and the fixing device 30 are made in press-contact (contact) with the continuous paper P. With this configuration, the transport force Fb of the second transfer device 28 and the transport force Fc of the fixing device 30 may be reduced to, for example, about 50 N or less.

That is, in the state in which the second transfer device 28 and the fixing device 30 are separated from the continuous paper P, the relationship of the above-described transport forces F, transport speeds V, and tensions T may be expressed by the following expressions:

Transport force F1 of first driving roll 34*a*>transport force F2 of second driving roll 36*a*

Transport speed V1 of first driving roll 34*a*<motor speed V2 of second driving roll 36*a*

Tension T=Ta=Tb=Tc=transport force F2 of second driving roll 36*a*

Transport speed V of continuous paper P=Va=Vb=Vc=V1·(1+Ta/WtE).

Furthermore, by changing the fixing speed V3, the value of Vb/V3 changes, and the transport force Fc of the fixing device 30 also changes. In accordance with this, optimal tensions Ta and Tb may be set.

With the above settings, the transport speed V and the tension T of continuous paper may be set in an optimal state. In general, it is desirable for paper with a width of about 300 mm to be transported with a tension T of about 50 N to 100 N. It is desirable for the transport speed V to be equal to the speed of the second transfer device 28. However, adjustment may be made for improvement of transfer performance or fine adjustment of magnification.

The determination as to whether or not the speed difference between the transport speed V and the fixing speed V3 of the continuous paper P has reached a range from approximately −0.5% to approximately 0.5% may be made by performing nipping after a certain period of time has passed since start up time based on a design value. The transport speed V varies depending on the thickness t of the continuous paper P. Therefore, the fixing speed V3 may be adjusted according to the thickness t. The thickness t of the continuous paper P may be calculated based on input by a user or may be detected using a thickness detector. In the case where the transport speed V is detected as described later, correction of the thickness t is unnecessary.

Next, an example in which the transport speed V and the fixing speed V3 of the continuous paper P are detected will be described. When the actual fixing speed V3 deviates due to various disturbances such as a change in the diameter of a driving roll or the diameter of heating and pressurizing rolls based on the temperature of the fixing device 30 and slipping, the transport force Fc varies, the tensions Tb and Ta of the continuous paper P deviate, and the transport speed V of the continuous paper P thus varies. Accordingly, defects such as non-uniformity of magnification and unevenness of density occur. By detecting the transport speed V of the continuous paper P, a change in the speed caused by a change in the tension T based on a change in the transport force may be detected. By controlling the fixing speed V3 according to the transport speed V, the transport force Fc may be made stable. Furthermore, by detecting the fixing speed V3, even if the actual speed deviates due to various disturbances such as a change in the diameter of a driving roll or the diameter of heating and pressurizing rolls based on the temperature and slipping, the fixing speed V3 of the fixing device 30 may be detected accurately, and a proper determination may be made.

Figure 8:
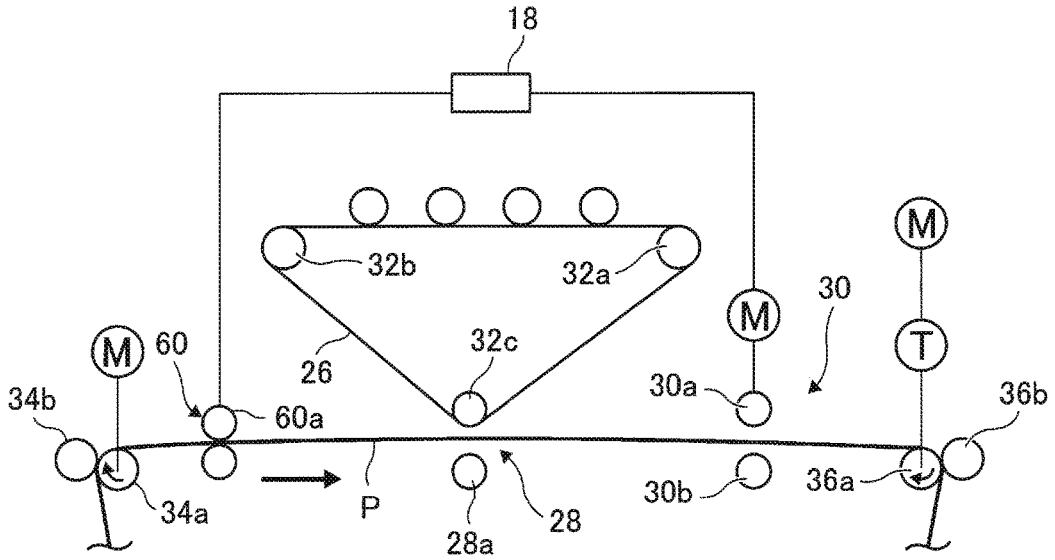
FIG. 8 is a diagram illustrating an example of speed detection used for an image forming apparatus according to an exemplary embodiment of the present invention.

FIG. 8 is a diagram illustrating an example of detecting the transport speed V of the continuous paper P.

In an exemplary embodiment, a speed detecting device 60 which detects the transport speed V of the continuous paper P is provided between the first driving roll 34*a* and the second transfer device 28 of the image forming apparatus 10.

The speed detecting device 60 includes a detection roller 60*a*. Regarding the transport speed V of the continuous paper P, the rotation speed of the detection roller 60*a* is detected using a rotary encoder by making the detection roller 60*a* in contact with the surface of the continuous paper P.

The controller 18 controls the driving speed (fixing speed) V3 of the motor M of the heating roll 30*a* in accordance with the transport speed V of the continuous paper P detected by the speed detecting device 60. Accordingly, image formation may be achieved at a stable speed (magnification) with a stable tension T.

When the transport speed V of the continuous paper P and the fixing speed V3 of the fixing device 30 are substantially equal with the difference between the transport speed V and the fixing speed V3 being within a range from approximately −0.5% to approximately 0.5%, the second transfer device 28 and the fixing device 30 which are separated from each other are brought into press-contact (contact) with each other.

The fixing speed V3 of the fixing device 30 may be detected so that the transport force F2 of the second driving roll 36*a* may be controlled according to the detected fixing speed V3.

Furthermore, control may also be performed by providing a tension detecting device which detects the tension T of the continuous paper P and detecting the tension T, instead of detecting the transport speed V of the continuous paper P.

Figure 9:
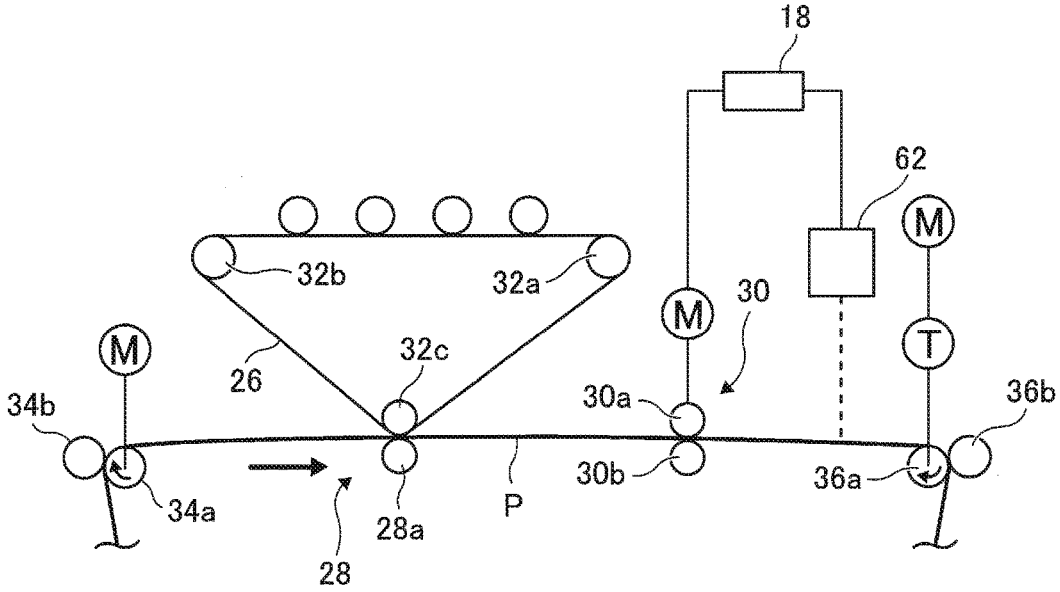
FIG. 9 is a diagram illustrating another example of speed detection used for an image forming apparatus according to an exemplary embodiment of the present invention.

FIG. 9 explains an example in which expansion or contraction of an image after fixation is detected and the fixing speed V3 is controlled.

In an exemplary embodiment, a magnification detecting device 62 which detects magnification of expansion or contraction of an image transferred to the continuous paper P is provided between the fixing device 30 and the second driving roll 36*a* of the image forming apparatus 10.

The magnification detecting device 62 detects an image formed using a camera or the like and calculates magnification.

The controller 18 controls the driving speed (fixing speed) V3 of the motor M of the heating roll 30*a* in accordance with the magnification of an image detected by the magnification detecting device 62. Accordingly, stable speed (magnification) control may be performed with a stable tension T. Furthermore, the transport force F2 of the second driving roll 36*a* may be controlled.

The image forming apparatus 10 described above includes the fixing device 30 of a roller system. However, a fixing device 70 of a belt system may be used.

Figure 10:
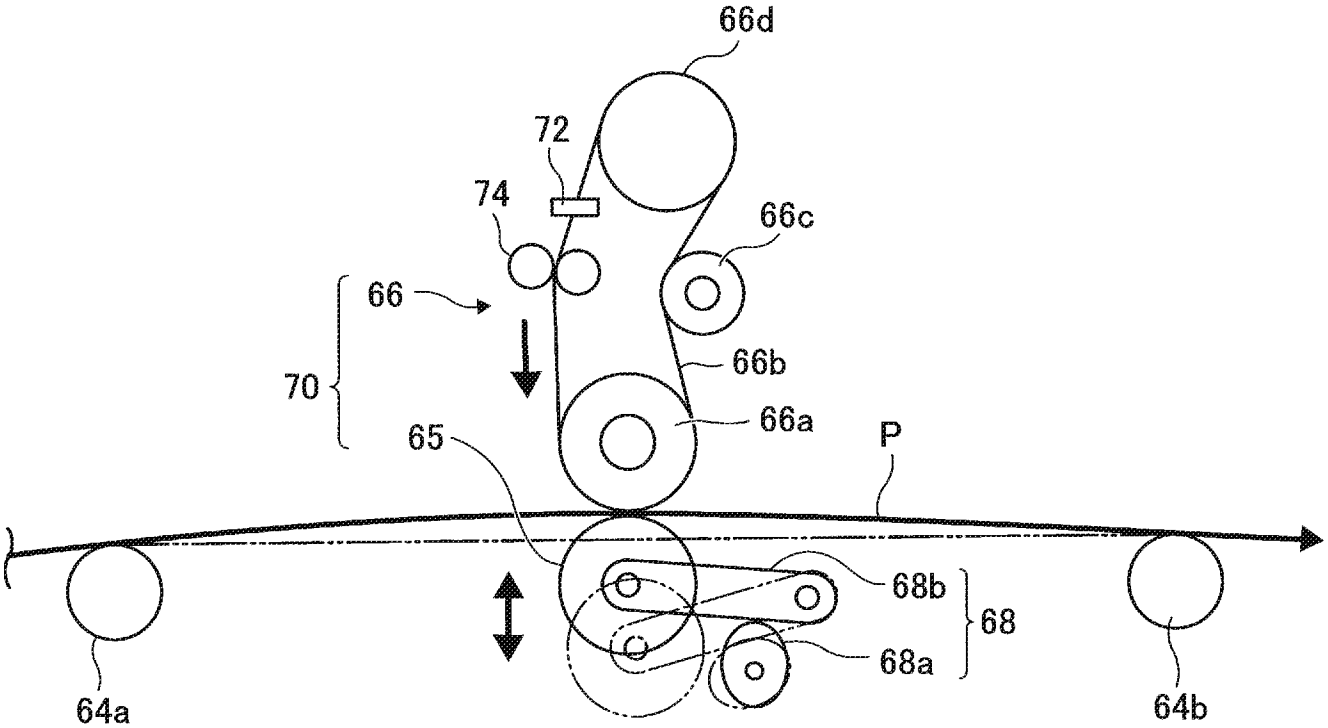
FIG. 10 is a diagram illustrating another example of a fixing device used in an image forming apparatus according to an exemplary embodiment of the present invention.

FIG. 10 is a diagram illustrating an example of the fixing device 70 of a belt system.

The fixing device 70 includes a pressuring roll 65 and a heating member 66 of a belt shape which is in press-contact with the pressuring roll 65 and is rotated.

The pressuring roll 65 includes a moving mechanism 68. The moving mechanism 68 includes a cam 68*a* and a link 68*b*. A motor, which is not illustrated in FIG. 10, is connected to the cam 68*a*. One end of the link 68*b* is connected to the central axis of the pressuring roll 65, and movement of the cam 68*a* causes the pressuring roll 65 to move around the other end of the link 68*b* in a direction in which the continuous paper P is in press-contact with the heating member 66 and a direction in which the continuous paper P is separated from the heating member 66.

The heating member 66 includes a heating roll 66*a*, a fixing belt 66*b*, an external heating roll 66*c*, and a meandering control roll 66*d* which are arranged at positions facing the pressuring roll 65. The heating roll 66*a* and the meandering control roll 66*d* support the fixing belt 66*b* from the inside, and the external heating roll 66*c* is provided between the heating roll 66*a* and the meandering control roll 66*d* and outside the fixing belt 66*b*.

The heating roll 66*a* performs driving and heating. The external heating roll 66*c* heats the fixing belt 66*b* from the outside to achieve a faster performance.

The meandering control roll 66*d* is configured to be tilted by rotation of a cam caused by a motor, which is not illustrated in FIG. 10, and tilt of the roll enables meandering of the fixing belt 66*b* to be controlled.

On the downstream side of the meandering control roll 66*d* in the direction in which the fixing belt 66*b* rotates, a meandering detecting sensor 72 is provided. The meandering detecting sensor 72 detects the position of the fixing belt 66*b* in the width direction thereof.

On the downstream side of the meandering detecting sensor 72 in the direction which the fixing belt 66*b* rotates and upstream side of the heating roll 66*a*, a speed detecting roll 74 is provided. On the same axis of the speed detecting roll 74, a rotary encoder is provided, and fixing speed is detected.

On the upstream side and downstream side of the fixing device 70 in the direction which the continuous paper P is transported, positioning rollers 64*a* and 64*b* are provided, so that the continuous paper P is not in contact with the fixing device 30 in a state in which the pressuring roll 65 is in a separated state.

That is, also with the fixing device 70 of the belt system described above, driving is started in the state in which the fixing device 70 is separated from the continuous paper P. After the transport speed V of the continuous paper P and the fixing speed detected by the speed detecting roll 74 have become substantially equal with the difference between the transport speed V and the fixing speed being within a range from approximately −0.5% to approximately 0.5%, the moving mechanism 68 of the pressuring roll 65 is controlled. Therefore, the pressuring roll 65 is moved in the direction in which the continuous paper P is in contact with the heating member 66, and the fixing device 70 is in press-contact with the continuous paper P.

In an exemplary embodiment, as the tension adjusting unit, a configuration in which the second driving roll 36*a* is connected to a motor via the torque limiter T has been described. However, the present invention is not limited to this. A slip clutch, a constant-torque driving motor, tension detection feedback control, or the like may be used.

Furthermore, in an exemplary embodiment, a configuration in which the first driving roll 34*a* on the upstream side of the second transfer device 28 in the direction in which the continuous paper P is transported is driven at a constant speed and the second driving roll 36*a* on the downstream side of the fixing device 30 in the direction in which the continuous paper P is transported is driven at a constant transport force has been described. However, the present invention is not limited to this. The first driving roll 34*a* on the upstream side of the second transfer device 28 in the direction in which the continuous paper P is transported may be driven as a load roll by a brake provided at the rotation axis or the like, and the second driving roll 36*a* on the downstream side of the fixing device 30 in the direction in which the continuous paper P is transported may be driven at a constant speed.

As described above, the present invention is not intended to be limited to the exemplary embodiments described above, and various modifications may be made to the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit that transports continuous paper;

a tension adjusting unit that adjusts tension of the continuous paper being transported by the transport unit;

a transfer unit that transfers an image to the continuous paper transported by the transport unit;

a fixing unit that fixes the image transferred by the transfer unit onto the continuous paper; and a controller that controls, in a case where the transport unit and the fixing unit are driven in a state in which the fixing unit and the transfer unit are separated from the continuous paper and a difference between a transport speed of the transport unit and a fixing speed of the fixing unit has reached a predetermined range, the fixing unit and the transfer unit are to be in press-contact with the continuous paper at the same timing, wherein the transport unit includes a first transport part that is provided on an upstream side of the transfer unit in a direction in which the continuous paper is transported, and a second transport part that is provided on a downstream side of the fixing unit in a direction in which the continuous paper is transported, and wherein one of the first transport part and the second transport part controls the transport speed of the continuous paper, and the other one of the first transport part and the second transport part serves as the tension adjusting unit and controls the tension of the continuous paper, wherein the controller controls the transport force of the second transport part according to the detected fixing speed which is detected using a speed detecting member.

2. The image forming apparatus according to claim 1, wherein in a case where the transfer unit is driven in a state in which the transfer unit is separated from the continuous paper and a difference between the transport speed of the transport unit and a transfer speed of the transfer unit has reached a predetermined range, the controller controls the transfer unit to be in press-contact with the continuous paper.

3. The image forming apparatus according to claim 2, wherein the transport unit includes a first transport part that is provided on an upstream side of the transfer unit in a direction in which the continuous paper is transported, and a second transport part that is provided on a downstream side of the fixing unit in a direction in which the continuous paper is transported, and wherein one of the first transport part and the second transport part controls the transport speed of the continuous paper, and the other one of the first transport part and the second transport part serves as the tension adjusting unit and controls the tension of the continuous paper.

4. The image forming apparatus according to claim 1, wherein the difference between the transport speed of the transport unit and the fixing speed of the fixing unit is within a range from approximately −0.5% to approximately 0.5%.

5. The image forming apparatus according to claim 2, wherein the difference between the transport speed of the transport unit and the fixing speed of the fixing unit is within a range from approximately −0.5% to approximately 0.5%.

6. The image forming apparatus according to claim 1, wherein the difference between the transport speed of the transport unit and the fixing speed of the fixing unit is within a range from approximately −0.5% to approximately 0.5%.

7. The image forming apparatus according to claim 3, wherein the difference between the transport speed of the transport unit and the fixing speed of the fixing unit is within a range from approximately −0.5% to approximately 0.5%.

8. A non-transitory computer readable medium storing a program causing a computer to execute a process for image formation, the process comprising:

transporting continuous paper;

adjusting tension of the continuous paper which is being transported;

transferring an image to the transported continuous paper;

fixing the transferred image transferred onto the continuous paper; and controlling, in a case where a fixing unit is driven in a state in which the fixing unit is separated from the continuous paper and a difference between a transport speed of the continuous paper and a fixing speed of the fixing unit has reached a predetermined range, the fixing unit to be in press-contact with the continuous paper, wherein the transporting the continuous paper is performed by a transport unit that includes a first transport part that is provided on an upstream side of a transfer unit, which transfers the image, in a direction in which the continuous paper is transported, and a second transport part that is provided on a downstream side of the that fixed the transferred image, in a direction in which the continuous paper is transported, and wherein one of the first transport part and the second transport part controls the transport speed of the continuous paper, and the other one of the first transport part and the second transport part serves as the tension adjusting unit and controls the tension of the continuous paper, and wherein a controller controls the transport force of the second transport part according to the detected fixing speed which is detected using a speed detecting member.

9. The image forming apparatus according to claim 1, wherein a member which is in contact with the continuous paper does not exist between the transfer unit and the fixing unit, wherein the path of the continuous paper is straight between an upper roller of a fixing unit and a lower roller of fixing unit in a state in which the transfer unit and the fixing unit are separate from the continuous paper.

10. The image forming apparatus according to claim 1, wherein the fixing speed of the fixing unit is adjusted according to the thickness of the continuous paper which is calculated based on input by a user or is detected using a thickness detector.

* * * * *